US006700027B1

(12) United States Patent
Johnson et al.

(10) Patent No.: US 6,700,027 B1
(45) Date of Patent: Mar. 2, 2004

(54) PROCESS FOR THE OLIGOMERIZATION OF OLEFINS IN FISCHER-TROPSCH CONDENSATE USING CHROMIUM CATALYST AND HIGH TEMPERATURE

(75) Inventors: David R. Johnson, Petaluma, CA (US); Christopher A. Simmons, El Cerrito, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 27 days.

(21) Appl. No.: 10/213,492

(22) Filed: Aug. 7, 2002

(51) Int. Cl.[7] ..... C07C 1/00; C07C 2/04; C10G 73/02; C10G 35/06

(52) U.S. Cl. ..... 585/329; 585/316; 585/510; 208/28; 208/136

(58) Field of Search ..... 585/316, 329, 585/510; 208/28, 136

(56) References Cited

U.S. PATENT DOCUMENTS

| | | | | |
|---|---|---|---|---|
| 3,852,207 | A | | 12/1974 | Stangeland et al. |
| 4,157,294 | A | | 6/1979 | Iwao et al. |
| 4,417,088 | A | | 11/1983 | Miller |
| 4,440,871 | A | | 4/1984 | Lok et al. |
| 4,568,663 | A | | 2/1986 | Mauldin |
| 4,673,487 | A | | 6/1987 | Miller |
| 4,827,064 | A | | 5/1989 | Wu |
| 4,827,073 | A | | 5/1989 | Wu |
| 4,990,709 | A | | 2/1991 | Wu |
| 5,208,005 | A | | 5/1993 | Miller |
| 5,264,642 | A | | 11/1993 | Wu |
| 5,276,229 | A | | 1/1994 | Buchanan et al. |
| 5,413,695 | A | | 5/1995 | Miller |
| 5,514,362 | A | | 5/1996 | Miller |
| 5,637,784 | A | * | 6/1997 | Chu et al. ..... 585/14 |
| 5,939,349 | A | | 8/1999 | Kibby et al. |
| 2001/0004972 | A1 | * | 6/2001 | Miller et al. ..... 208/18 |

FOREIGN PATENT DOCUMENTS

| | | |
|---|---|---|
| EP | 0 609 079 B1 | 7/1998 |

* cited by examiner

*Primary Examiner*—J. Parsa
(74) *Attorney, Agent, or Firm*—James W. Ambrosius

(57) ABSTRACT

A process for increasing the yield of $C_{10}$ plus hydrocarbon products from a Fischer-Tropsch plant which comprises (a) recovering a Fischer-Tropsch condensate fraction boiling below about 700 degrees F. from the Fischer-Tropsch plant, wherein said fraction contains at least 10 weight percent and preferably more olefins; (b) contacting the olefins in the Fischer-Tropsch condensate fraction under oligomerization conditions, at a reaction temperature between about 650 degrees F. and 800 degrees F. with an oligomerization catalyst comprising active chromium on an inert support; and (c) recovering a $C_{10}$ plus hydrocarbon product.

18 Claims, No Drawings

PROCESS FOR THE OLIGOMERIZATION OF OLEFINS IN FISCHER-TROPSCH CONDENSATE USING CHROMIUM CATALYST AND HIGH TEMPERATURE

FIELD OF THE INVENTION

The invention relates to a process for upgrading Fischer-Tropsch products by increasing the yield of diesel and lubricating base oils through the oligomerization of olefins in the condensate using a chromium catalyst and high temperature.

BACKGROUND OF THE INVENTION

Products prepared from the Fischer-Tropsch process comprise a mixture of various solid, liquid, and gaseous hydrocarbons. Those Fischer-Tropsch products which boil within the range of lubricating base oil and diesel are usually of higher value than lower boiling products, such as naphtha, or normally gaseous products, such as LPG. Obviously, it is advantageous to capture the carbon value of the lower boiling and normally gaseous products by upgrading them to higher molecular weight and higher value products.

High quality lubricating base oils may be prepared from the Fischer-Tropsch wax recovered as one of the products of the Fischer-Tropsch synthesis. A process for upgrading the other hydrocarbon products recovered from the Fischer-Tropsch process into suitable feedstocks for preparing high quality lubricating base oils is highly desirable. Lubricating base oils typically will have an initial boiling point above about 315 degrees C. (600 degrees F.). High quality diesel products also may be prepared from the syncrude recovered from the Fischer-Tropsch process. Fischer-Tropsch derived diesel typically has very low sulfur and aromatics content and an excellent cetane number. These qualities make Fischer-Tropsch derived diesel an excellent blending stock for upgrading lower quality petroleum-derived diesel. Accordingly, it is desirable to be able to maximize the yields of such higher value hydrocarbon products which boil within the range of lubricating base oils and diesel. At the same time, it is desirable to minimize the yields of lower value products, such as naphtha, and $C_4$ minus products.

All syncrude Fischer-Tropsch products as they are initially recovered from the Fischer-Tropsch reactor contain varying amounts of olefins depending upon the type of Fischer-Tropsch operation employed. In addition, the crude Fischer-Tropsch product also contains a certain amount of oxygenated hydrocarbons, especially alcohols, which are reported to act as poisons to most oligomerization catalysts. In conventional processes, these oxygenates may be removed through a hydrotreating step, or, alternatively, they may be readily converted to olefins by a dehydration step. The olefins originally present in the Fischer-Tropsch products or derived from converted oxygenates may be oligomerized to yield hydrocarbons having a higher molecular weight than the original feed. The oligomerization of olefins has been well reported in the literature and a number of commercial processes are available. See, for example, U.S. Pat. Nos. 4,417,088; 4,827,064; 4,827,073, and 4,990,709. Oligomerization also introduces desirable branching into the hydrocarbon molecule which lowers the pour point of the diesel and lubricating base oil products, thereby improving the cold flow properties of the product. See for example U.S. Pat. No. 4,417,088. The use of chromium as the active metal in the oligomerization catalyst has been described in the literature. See, for example U.S. Pat. Nos. 4,827,073; 4,990,709, and 5,264,642. However, the maximum temperature under which the oligomerization reaction will proceed without promoting undesired side reactions has been reported to be about 480 degrees F. (250 degrees C.).

Fischer-Tropsch wax refers to a high boiling fraction from the Fischer-Tropsch derived syncrude and is most often a solid at room temperature. For the purpose of this disclosure "Fischer-Tropsch wax" will be contained in the higher boiling portion of the Fischer-Tropsch syncrude and will have an initial boiling point approximately the same as that for lubricating base oil, i.e., above about 315 degrees C. (600 degrees F.). The term "Fischer-Tropsch condensate" refers in this disclosure to that fraction of the Fischer-Tropsch syncrude which is normally liquid at ambient temperature. Accordingly, the Fischer-Tropsch condensate fraction is that fraction which includes those hydrocarbons generally having five or more carbon atoms in their molecular structure but having a lower boiling range than Fischer-Tropsch wax.

As used in this disclosure, the term "$C_{19}$ minus Fischer-Tropsch product" refers to a product recovered from a Fischer-Tropsch reaction zone which is predominantly comprised of hydrocarbons having 19 carbon atoms or less in the molecular structure. One skilled in the art will recognize that such products may actually contain a significant amount of hydrocarbons containing greater than 19 carbon atoms. In general, what is referred to are those hydrocarbons having a boiling range of diesel and below. In general, for the purposes of this disclosure, diesel is considered as having an upper boiling point of about 700 degrees F. (370 degrees C.) and an initial boiling point of about 300 degrees F. (about 150 degrees C.). Diesel may also be referred to as $C_{10}$ to $C_{19}$ hydrocarbons. Likewise, Fischer-Tropsch wax preferably is comprised predominantly of "$C_{20}$ plus product" and refers to a product comprising primarily hydrocarbons having 20 or more carbon atoms in the structure of the molecule. $C_{20}$ plus product will have an initial boiling point at the upper end of the boiling range for diesel, i.e., above about 600 degrees F. (315 degrees C.). It should be noted that the upper end of the boiling range for diesel and the lower end of the boiling range for Fischer-Tropsch wax have considerable overlap. The term "naphtha" when used in this disclosure refers to a liquid product having between about $C_5$ to about $C_9$ carbon atoms in the molecular structure and will have a boiling range generally below that of diesel but wherein the upper end of the boiling range will overlap that of the initial boiling point of diesel. The term $C_{10}$ plus hydrocarbons refers to those hydrocarbons generally boiling above the range of naphtha, i.e., the fractions boiling within the range of diesel and lubricating base oils or above about 150 degrees C. Products recovered from the Fischer-Tropsch synthesis which are normally in the gaseous phase at ambient temperature are referred to as $C_4$ minus product in this disclosure. LPG which is primarily a mixture of propane and butane is an example of a $C_4$ minus product. The precise cut-point selected for each of the products in carrying out the distillation operation will be determined by the product specifications and yields desired.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

SUMMARY OF THE INVENTION

The present invention is directed to a process for increasing the yield of $C_{10}$ plus hydrocarbon products from a Fischer-Tropsch plant which comprises (a) recovering a Fischer-Tropsch condensate fraction boiling below about 700 degrees F. from the Fischer-Tropsch plant, wherein said fraction contains at least 10 weight percent olefins; (b) contacting the olefins in the Fischer-Tropsch condensate fraction under oligomerization conditions, at a reaction temperature between about 650 degrees F. and 800 degrees F. with an oligomerization catalyst comprising active chromium on an inert support; and (c) recovering a $C_{10}$ plus hydrocarbon product having a higher average molecular weight than the Fischer-Tropsch condensate. The amount of olefins present in the Fischer-Tropsch condensate fraction will vary depending on the way in which the Fischer-Tropsch synthesis is carried out. From an economic perspective the more olefins present, the more $C_{10}$ plus product will be recovered. Preferably, the condensate fraction will contain at least 20 percent olefins by weight; more preferably, at least 30 percent olefins by weight; and most preferably, at least 50 percent olefins by weight.

Almost all Fischer-Tropsch syncrudes contain a certain amount of oxygenates. In conventional oligomerization processes, the oxygenates will act as a catalyst poison and must either be removed or converted into olefins prior to the oligomerization step. In the present invention the oxygenates need not be converted or removed prior to oligomerization, since it has been found that the oxygenates will not deactivate the chromium catalyst under the conditions of the process. Surprisingly, it has been discovered that the presence of oxygenates has no significant detrimental effect on catalyst activity when the process is carried out according to the invention. The present process may be carried out in the presence of 10 weight percent and even 20 weight percent oxygenates.

DETAILED DESCRIPTION OF THE INVENTION

In the Fischer-Tropsch synthesis process, liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (149 degrees to 371 degrees C.) preferably from about 400 degrees to about 550 degrees F. (204 degrees to 228 degrees C.); pressures of from about 10 to about 600 psia, (0.7 to 41 bars) preferably 30 to 300 psia, (2 to 21 bars) and catalyst space velocities of from about 100 to about 10,000 cc/g/hr., preferably 300 to 3,000 cc/g/hr.

The products from the Fischer-Tropsch synthesis may range from $C_1$ to $C_{200}$ plus hydrocarbons with a majority in the $C_5$–$C_{100}$ plus range. The reaction can be conducted in a variety of reactor types, such as, for example, fixed bed reactors containing one or more catalyst beds, slurry reactors, fluidized bed reactors, or a combination of different type reactors. Such reaction processes and reactors are well known and documented in the literature. The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, also completely incorporated herein by reference for all purposes.

Suitable Fischer-Tropsch catalysts comprise one or more Group VIII catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

As already noted, all Fischer-Tropsch syncrude contains olefins with the amount dependent to some extent on the way in which the Fischer-Tropsch synthesis is conducted. In the present invention, it is advantageous to conduct the Fischer-Tropsch synthesis in a way that maximizes the production of olefins in the condensate fraction. Preferably the olefins will comprise at least 20 weight percent of the condensate fraction, more preferably at least 30 weight percent, and most preferably at least 50 weight percent. Most Fischer-Tropsch syncrudes also contain a certain amount of oxygenates, mostly alcohols. Although unlike some prior art processes these oxygenates do not need to be removed in the present process, it may be advantageous to convert the alcohols into olefins prior to oligomerization.

In some Fischer-Tropsch syncrude, oxygenates may comprise greater than 10 weight percent of the total. The presence of more than 15 weight percent oxygenates in the condensate fraction is not unusual. If desired, the alcohols in the feed may be dehydrated to convert them into olefins prior to the oligomerization step by processing the feedstock over a catalyst, typically gamma alumina. The dehydration of alcohols to olefins is discussed in Chapter 5, "Dehydration" in Catalytic Processes and Proven Catalysts by Charles L. Thomas, Academic Press, 1970.

The present invention is intended to maximize the yield of heavy products, especially lubricating base oils and diesel, by oligomerizing the olefins in the Fischer-Tropsch condensate and those olefins, if any, produced by the dehydration of alcohols. During oligomerization the lighter olefins are converted into heavier products. The carbon structure of the oligomers will also display branching at the points of molecular addition. Due to the introduction of branching into the molecule, the pour point properties of the products are enhanced making the final products of the oligomerization operation excellent candidates for blending components to upgrade lower quality conventional petroleum-derived products to meet market specifications.

Preferably, the oligomerized product will have an average molecular weight at least 10 percent higher than the initial feedstock, preferably at least 20 percent higher. Although the oligomerization reaction will proceed over a wide range of conditions, with the present invention the temperature is maintained between about 650 degrees F. (343 degrees C.) and about 800 degrees F. (427 degrees C.), with temperatures within the range of from about 700 degrees F. (371 degrees C.) and about 775 degrees F. (413 degrees C.) being preferred. The oligomerization reaction may be conducted in either a batch-type reactor or in a fixed-bed continuous flow reactor. A fixed-bed, continuous flow reactor is usually preferred. Other oligomerization conditions include a space velocity from 0.1 to 3 LHSV and a pressure from 0 to 2000 psig.

The catalyst used in carrying out the process of the present invention comprises active chromium on a high surface area support. A complete description of the catalyst which may be used to carry out the invention and its method of preparation may be found in U.S. Pat. No. 4,827,073. The active component of the catalyst is chromium which is preferably present in a lower valence state. Although the valence of the active chromium is not certain, the active form is believed to be chromium II. However, the inventors do not wish to be bound by the exact oxidation state of the chromium in describing the invention.

It is important that the chromium be highly dispersed on the support. Preferred support materials include silica, alumina, titania, silica alumina, and magnesium, with silica being especially preferred. The support should be a porous material preferably having an average pore opening between about 40 Angstroms and about 350 Angstroms, more preferably with an average pore opening between about 60 Angstroms and about 300 Angstroms. Silica supports having an average pore diameter of about 150 Angstrom units have been found to give especially satisfactory results when used to carry out the oligomerization step. Typically the chromium is impregnated on the porous support using procedures well known to those skilled in the art. After the active metal is impregnated onto the support the catalyst is dried and calcined. In the finished catalyst, the chromium will usually be present in an amount within the range from about 0.2 weight percent to about 5 weight percent, with an amount between about 0.5 weight percent and about 2 weight percent being preferred. The catalyst usually must be reduced to activate the metal prior to use. Methods for reducing the chromium to its active form have been well described in the literature. Generally, a reducing gas such as carbon monoxide or hydrogen is passed over the catalyst.

The oligomerization product recovered from the oligomerization operation will usually be further processed in order to meet the specifications for the final product. The additional processing may be intended to improve the cold flow properties of the product by means of a dewaxing operation or to improve its oxidation stability by means of a hydrofinishing operation. The dewaxing of the oligomerization product is preferably carried out as a catalytic hydroisomerization step in order to minimize the wax cracking which reduces the yield of the higher molecular weight products.

Catalytic hydroisomerization is intended to achieve high conversion levels of wax to non-waxy iso-paraffins while at the same time minimizing the conversion by cracking. Since wax conversion can be complete, or at least very high, this process typically does not need to be combined with additional dewaxing processes to produce a lubricating oil base stock with an acceptable pour point. Isomerization operations suitable for use with the present invention typically uses a catalyst comprising an acidic component and may optionally contain an active metal component having hydrogenation activity. The acidic component of the catalysts preferably includes an intermediate pore SAPO, such as SAPO-11, SAPO-31, and SAPO41, with SAPO-11 being particularly preferred. Intermediate pore zeolites, such as ZSM-22, ZSM-23, SSZ-32, ZSM-35, and ZSM48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 5.3 to about 6.5 Angstrom when the porous inorganic oxide is in the calcined form. Molecular sieves having pore apertures in this range tend to have unique molecular sieving characteristics. Unlike small pore zeolites such as erionite and chabazite, intermediate pore zeolites will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having a hydrogenation component, it is usually preferred that the metal be deposited on the catalyst using a non-aqueous method. Non-zeolitic molecular sieves include tetrahedrally-coordinated [AlO2] and [PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Hydrofinishing operations are intended to improve the UV stability and color of the products. Unsaturated bonds remaining in the Fischer-Tropsch product will be hydrogenated in the hydrofinishing operation. A general description of the hydrofinishing process may be found in U.S. Pat. Nos. 3,852,207 and 4,673,487. As used in this disclosure, the term UV stability refers to the stability of the lubricating base oil or other products when exposed to ultraviolet light and oxygen. Instability is indicated when a visible precipitate forms or darker color develops upon exposure of the product to ultraviolet light and air which results in a cloudiness or floc. Lubricating base oils and diesel products prepared by the process of the present invention generally will require UV stabilization before they are suitable for use in the manufacture of commercial lubricating oils and marketable diesel.

In the present invention, the total pressure in the hydrofinishing zone will be above 500 psig, preferably above 1000 psig, and most preferably will be above 1500 psig. The maximum total pressure is not critical to the process, but due to equipment limitations the total pressure will not exceed 3000 psig and usually will not exceed about 2500 psig. Temperature ranges in the hydrofinishing zone are usually in the range of from about 300 degrees F. (150 degrees C.) to about 700 degrees F. (370 degrees C.), with temperatures of from about 400 degrees F. (205 degrees C.) to about 500 degrees F. (260° C.) being preferred. The LHSV is usually within the range of from about 0.2 to about 2.0, preferably 0.2 to 1.5, and most preferably from about 0.7 to 1.0. Hydrogen is usually supplied to the hydrofinishing zone at a rate of from about 1000 to about 10,000 SCF per barrel of feed. Typically, the hydrogen is fed at a rate of about 3000 SCF per barrel of feed.

Suitable hydrofinishing catalysts typically contain a Group VIII noble metal component together with an oxide support. Metals or compounds of the following metals which are contemplated as useful in hydrofinishing catalysts include ruthenium, rhodium, iridium, palladium, platinum, and osmium. Preferably, the metal or metals will be platinum, palladium or mixtures of platinum and palladium. The refractory oxide support usually consists of silica-alumina, silica-alumina-zirconia, and the like. Typical hydrofinishing catalysts are disclosed in U.S. Pat. Nos. 3,852,207; 4,157,294 and 4,673,487.

The following examples are intended to further clarify the invention but are not to be construed as a limitation thereon.

EXAMPLES

Example 1

A chromium based oligomerization catalyst was prepared by dissolving 7.8 g of $Cr(NO_3)_3.9H_2O$ (13% Cr) in deionized water and diluting the total volume of the solution to 164 ml. This solution was slowly added to 106 g of silica gel (Davisil grade 646 35–60 mesh, 150 Å average pore diameter, 300 m2/g, 1.15 cc/g pore volume) with stirring. The wet material was allowed to stand for 2 hours and 10 minutes. The material was dried in a drying dish in an oven at 250 degrees F. (121 degrees C.). The dish containing the dried material was put into a muffle furnace and calcined by increasing the temperature in the oven from room temperature to 1475 degrees F. (802 degrees C.) at 100 degrees F. per hour while passing dry air over the material at a rate of one cubic foot per hour. The temperature was held at 1475 degrees F. (802 degrees C.) for 16 hours with continued air flow. The material was cooled down to room temperature in flowing air.

Analysis by ICP of the finished catalyst found the chromium content to be 0.6 wt %.

Example 2

A tubular reactor was packed with 15 cc of 24–42 mesh chromium catalyst prepared using the procedure of Example 1 and installed in a continuous test unit. The reactor was pressure tested with nitrogen, and the catalyst was dried with flowing nitrogen at 350 degrees F. overnight at atmospheric pressure. The temperature was cooled to 200 degrees F., and the gas to the reactor switched to hydrogen. After one hour the pressure was increased to 800 psig and the temperature was increased to 700 degrees F. over time at a rate of 100 degrees F. per hour in order to reduce the catalyst. After a one hour hold at 700 degrees F., the temperature was cooled to 150 degrees F. The hydrogen gas was shut off, and hexadecene feed was introduced into the reactor at a rate of 0.5 LHSV. The reactor temperature was increased to 550 degrees F. at the rate of 50 degrees F. per hour and held overnight at 550 degrees F. Subsequently, the reactor temperature was increased over time to 675 degrees F. at the rate of 50 degrees F. per hour. The reactor effluent flowed to a stripper. By adjusting the stripper temperature and the nitrogen strip gas rate, the cut point between overhead and bottoms was approximately 650 degrees F.

After running 375 hours with the hexadecene feed, the feed was changed to an octane+hexadecane feed, then thermally cracked wax, and then at 792 total run hours to a Fischer-Tropsch condensate having the following inspections:

| | |
|---|---|
| API GRAVITY | 56.47 |
| BROMINE NUMBER, g Br/100 g sample | 44.1000 |
| CALCULATED OLEFIN CONTENT, Wt % | 46 |
| OXYGEN CONTENT, Wt % | 1.58 |
| D2887 Simulated TBP | |

| WT % | ° F. |
|---|---|
| .5 | 85 |
| 5 | 198 |
| 10 | 237 |
| 20 | 283 |
| 30 | 302 |
| 50 | 378 |
| 70 | 419 |
| 80 | 452 |
| 90 | 485 |
| 95 | 518 |
| 99.5 | 628 |

Example 3

The reactor described in Example 2 was operated with the Fischer-Tropsch condensate feed for a total of 935 hours during which time product was periodically collected and analyzed. From the results of the analysis the yield of product having an initial boiling point above 650 degrees F. was determined and the conversion of the olefins present in the Fischer-Tropsch condensate was calculated. The results for the various run periods are shown in the following Table.

TABLE

| Run Hours | Rx, ° F. | Pressure, psig | LHSV | Yield 650F + wt % | Conversion of Olefins wt % | Stripper Bottoms Properties[1] Pour, C. | VI | KV @ 100 C., cSt |
|---|---|---|---|---|---|---|---|---|
| 814–838 | 750 | 1600 | 0.50 | 28.4% | 61.8% | 1 | 137 | 3.745 |
| 862–887 | 750 | 1600 | 0.49 | 29.2% | 63.6% | 9 | 141 | 5.846 |
| 887–911 | 750 | 1600 | 0.50 | 29.4% | 63.8% | 7 | 142 | 5.67 |
| 1174–1197 | 750 | 1600 | 0.50 | 28.5% | 62.0% | 6 | 139 | 4.324 |

TABLE-continued

| Run Hours | Rx, ° F. | Pressure, psig | LHSV | Yield 650F + wt % | Conversion of Olefins wt % | Stripper Bottoms Properties[1] Pour, C. | VI | KV @ 100 C., cSt |
|---|---|---|---|---|---|---|---|---|
| 1197–1222 | 750 | 1600 | 0.50 | 28.2% | 61.2% | 8 | 143 | 5.244 |
| 1366–1391 | 750 | 1600 | 0.50 | 28.0% | 60.8% | 8 | 143 | 4.988 |
| 1655–1679 | 749 | 1600 | 0.55 | 28.6% | 62.2% | 5 | 138 | 3.644 |
| 1703–1727 | 749 | 1600 | 0.52 | 28.9% | 62.8% | 7 | 137 | 3.944 |

[1]Boiling ranges for the Stripper Bottoms are not the same for all run hours.

It should be noted from the results shown in the Table that excellent conversion was achieved for the olefins originally present in the Fischer-Tropsch condensate. In all cases the conversion exceeded 60 weight percent. It should also be noted that there was no deterioration of the catalyst activity observed over the entire period of the tests. The catalyst activity at 1703–1727 hours was virtually the same or even slightly higher than had been observed at 814–838 hours. The yield of 650 degree F. plus product also remained constant over the period of the test. Finally, it should be noted that the condensate feed contained significant amounts of oxygenated materials as demonstrated by the oxygen content (1.58 weight %) shown in the feed inspections of Example 2. Notwithstanding the presence of the oxygenates, the olefin conversion and yield of 650 degree F. plus product was very good.

What is claimed is:

1. A process for increasing the yield of $C_{10}$ plus hydrocarbon products from a Fischer-Tropsch plant which comprises:

(a) recovering a Fischer-Tropsch condensate fraction boiling below about 700 degrees F. from the Fischer-Tropsch plant, wherein said fraction contains at least 10 weight percent olefins;

(b) contacting the olefins in the Fischer-Tropsch condensate fraction under oligomerization conditions, at a reaction temperature between about 650 degrees F. and 800 degrees F. with an oligomerization catalyst comprising active chromium on an inert support; and (c) recovering a $C_{10}$ plus hydrocarbon product having a higher average molecular weight than the Fischer-Tropsch condensate.

2. The process of claim 1 wherein the $C_{10}$ plus hydrocarbon product comprises a fraction having a boiling range between about 300 degrees F. and 700 degrees F.

3. The process of claim 1 wherein the $C_{10}$ hydrocarbon product comprises a product having an initial boiling point above about 600 degrees F.

4. The process of claim 1 wherein the Fischer-Tropsch condensate further contains at least 10 weight percent of oxygenates.

5. The process of claim 4 wherein the Fischer-Tropsch condensate contains at least 15 weight percent oxygenates.

6. The process of claim 1 wherein the Fischer-Tropsch condensate fraction contains at least 20 weight percent olefins.

7. The process of claim 6 wherein the Fischer-Tropsch condensate fraction contains at least 30 weight percent olefins.

8. The process of claim 7 wherein the Fischer-Tropsch condensate fraction contains at least 50 weight percent olefins.

9. The process of claim 1 wherein the average molecular weight of the hydrocarbon product recovered in step (c) is at least 10 percent higher than the Fischer-Tropsch condensate fraction.

10. The process of claim 9 wherein the average molecular weight of the hydrocarbon product recovered in step (c) is at least 20 percent higher than the Fischer-Tropsch condensate fraction.

11. The process of claim 1 wherein the reaction temperature during oligomerization is between about 700 degrees F. and 775 degrees F.

12. The process of claim 1 wherein the inert support comprises a porous support material.

13. The process of claim 12 wherein the average diameter of the pore openings in the porous support material is between about 40 and about 350 Angstrom.

14. The process of claim 13 wherein the average diameter of the pore openings in the porous support material is between about 60 and about 300 Angstrom.

15. The process of claim 12 wherein the inert support in the oligomerization catalyst comprises silica.

16. The process of claim 1 including the additional step of dewaxing the $C_{10}$ plus hydrocarbon product.

17. The process of claim 16 wherein the dewaxing step is carried out as a catalytic hydroisomerization step.

18. The process of claim 1 including the additional step of hydrofinishing the $C_{10}$ plus hydrocarbon product.

* * * * *